United States Patent [19]

Conn

[11] 4,043,555

[45] Aug. 23, 1977

[54] RACQUET STRING AND METHOD

[75] Inventor: Bartley Russell Conn, Mountain View, Calif.

[73] Assignee: Irradiated Strings, Inc., Mountain View, Calif.

[21] Appl. No.: 661,734

[22] Filed: Feb. 26, 1976

[51] Int. Cl.[2] ..... A63B 49/00; D02G 3/02

[52] U.S. Cl. ..... 273/73 D; 57/157 R; 204/159.19

[58] Field of Search ..... 57/140 R, 157 R; 204/159.19; 273/73 D

[56] References Cited

U.S. PATENT DOCUMENTS

| | | | |
|---|---|---|---|
| 2,401,291 | 5/1946 | Smith | 57/140 |
| 2,858,259 | 10/1958 | Lawton et al. | 204/159.19 |
| 2,967,137 | 1/1961 | Lawton | 204/159.19 |
| 3,842,705 | 10/1974 | Woodard et al. | 204/159.19 X |

*Primary Examiner*—Richard C. Queisser
*Assistant Examiner*—Charles Gorenstein
*Attorney, Agent, or Firm*—Owen, Wickersham & Erickson

[57] ABSTRACT

A filamented polymer material of standard compounding, originally extruded or vertically drawn to a uniform diameter and having typical strength and resiliency characteristics, is converted to a material having increased resiliency characteristics simulating those of catgut and lamb gut for use in tennis racquets. The method for the conversion comprises subjecting a filament or a plurality of twisted together filaments of the material to irradiation, which causes a crosslinking of its molecules.

4 Claims, No Drawings

RACQUET STRING AND METHOD

BACKGROUND OF THE INVENTION

This invention relates to an improved synthetic tennis string material, to a method for making the string material, and to a tennis racquet incorporating the material.

In the game of tennis the characteristics of the material used for the racquet strings can be an extremely important factor in achieving optimum player performance. The strings of the racquet must have adequate strength so that they can be installed with a high degree of tension and thereby provide firmness, yet resiliency. Heretofore, among those familiar with tennis and the various types of racquets and materials, natural "gut" string, usually derived from lambs and consisting of a large number of twisted together fibers, was universally recognized as being superior to any synthetic string such as monofilament nylon. The reason for the aforesaid preference was mainly because of the strength and unique resiliency characteristics of nautral gut material. Also, twisted gut string in addition to its strength has a natural surface roughness, as opposed to a characteristic smoothness for artificial or synthetic monofilament string. This natural surface characteristic of gut string is important to a tennis player who wishes to put spin or "English" on the ball as he hits it.

Because of its natural origin and the difficulties in curing it for use, "gut" material has become relatively expensive. Although attempts have been made to utilize synthetic monofilament materials and even to combine a plurality of strands of monofilament to provide tennis strings, no artificial string material, prior to my invention, closely approximated the desired strength, resiliency, and roughness characteristics of natural "gut" material. Also, such synthetic strings have to a certain extent been subject to deterioration from heat and to relatively rapid wear as compared to gut strings and to strings prepared according to my invention.

BRIEF SUMMARY OF THE INVENTION

The present invention solves the aforesaid problem and provides an artificial or synthetic string that closely simulates natural "gut" string in the important characteristics of strength, resiliency and also surface roughness. The improved string according to my invention is originally in the form of a filament of polymer material, preferably nylon, which is either drawn or extruded to a uniform diameter. As a monofilament or as plural twisted together filaments, this material is subjected to irradiation of an intensity sufficient to cause a crosslinking of polymer molecules. Cobalt 60 or other forms of radiations may be used.

The result is a racquet string of improved stretch resilience, or resilience under tension, very close to the resilience of gut strings. Knurling or other surface treatment may be used on the string as a monofilament to produce a desirable surface roughness, further improving the play characteristics of the string when strung in a tennis racquet. Preferably, however, a plurality of small-diameter filaments may be twisted together and irradiated to produce a tennis racquet string of superior characteristics, closely approximating those of gut string in resiliency and surface roughness when strung in a tennis racquet. Racquet string prepared according to the invention may also be used advantageously in other strung racquets such as squash and badminton racquets.

Irradiated racquet string prepared according to the invention has also shown improved wear characteristics and thermal stability over prior synthetic string.

It is therefore among the objects of the invention to provide an inexpensive synthetic racquet string which exhibits greatly improved play wear and stability characteristics over prior synthetic strings, and which compares very favorably with gut string, especially in resiliency. Other objects, advantages and features of the invention will become apparent from the following description of a preferred embodiment.

DESCRIPTION OF THE PREFERRED EMBODIMENT

In the method of the invention a polymer material of standard compounding, extruded or drawn into a filament of generally uniform diameter, is used as a starting material. A typical preferred polymer material for the process is nylon, which has heretofore been sometimes employed as a racquet string material but without treatment according to the method of the present invention. Any synthetic polymer having properties similar to nylon is suitable. If a monofilament racquet string is to be formed, the original polymer filament is preferably of an effective diameter of from 0.045 to 0.065 inch, and more preferably within the range of 0.050 to 0.055 inch. Often a monofilament of this type is not perfectly round in cross section, but rather it is somewhat oblong. Therefore, the term "effective diameter", herein and in the appended claims, refers to the diameter which a sample, if round in cross section, would be to produce the same cross sectional area as that of the actual sample.

The racquet string of the invention is preferably formed from multiple small-diameter polymer filaments twisted together to an effective diameter of about 0.055 inch prior to irradiation. This multifilament string exhibits some surface roughness, which is desirable in play.

Irradiation of the string is performed in the usual manner by exposing the string to a dose of radiation, preferably cobalt 60 radiation. The equipment used for this treatment may be similar to that manufactured by General Electric Company. For the desired improvement in physical properties of the string, the quantity or dosage of radiation absorbed by the string material should be in the range of 7.5 to 12.5 megarads. The irradiation causes crosslinking of the polymer molecules, but it has been found that above about 12.5 megarads the network molecular chains become shorter, diminishing the tensile strength of the string. 10 megarads is the preferred dosage for consistently good results in improving the properties of the material.

The only noticeable visual change in the string material due to irradiation is a darkening of the color of the string from an almost colorless, whiteish color to a deeper, light amber color.

Testing of irradiated multifilament strings showed marked changed in physical properties as compared with similarly tested untreated strings, and showed a near duplication of similarly tested gut material strings, which comprised a plurality of twisted-together lamb gut strands.

In the testing, three sample strings of untreated monofilament nylon, three of irradiated multifilament nylon, and two of standard multifilament catgut were tested by stretching to failure. The ends of the sample were pulled away from one another at a speed of one inch per minute. On the testing instrument each end of a sample was doubly knotted and looped over a ½ inch diameter pin. Fracture of the sample occurred in almost very instance in the area of a knot. The loading or tensile strength of the sample was measured until fracture, at which point the elongation of the sample was also measured. Each of the samples had an effective diameter of 0.053 to 0.055 inch.

The results of the tests were as follows:

| SAMPLE | GUT #1 | GUT #2 | |
|---|---|---|---|
| Maximum tensile strength: lbs. | 74.7 | 66.8 | |
| Length of samples, inches | 10.2 | 11.2 | |
| Elongation at fracture, inches | 2.5 | 2.4 | |
| Percent elongation at fracture | 24.5 | 21.5 | |
| SAMPLE | Untreated Nylon #1 | Untreated Nylon #2 | Untreated Nylon #3 |
| Maximum tensile strength, lbs. | 148 | 138 | 137 |
| Length of sample, inches | 9.8 | 9.6 | 10.0 |
| Elongation at fracture, inches | 4.9 | 4.4 | 4.9 |
| Percent elongation at fracture | 50.0 | 45.8 | 49.0 |
| SAMPLE | Irradiated Nylon #1 | Irradiated Nylon #2 | Irradiated Nylon #3 |
| Maximum tensile strength, lbs. | 67 | 74 | 67 |
| Length of sample, inches | 9.8 | 11.1 | 11.0 |
| Elongation at fracture, inches | 2.9 | 3.2 | 3.0 |
| Percent elongation at fracture | 29.6 | 28.8 | 27.3 |

These test data indicate a striking alteration in the physical properties of the nylon string by the irradiation step. Both the maximum tensile strength and the percent of elongation at failure greatly differed between the untreated nylon monofilament and the irradiated nylon multifilament, with the properties of the irradiated strings approximating those of the tested catgut strings. This gives a strong indication that the resilience of the irradiated string under tension will be similar to that of gut string.

The increase in resilience was confirmed when multifilament nylon string irradiated in accordance with the method of the invention was strung in a tennis racquet and tested along with similarly strung untreated monofilament nylon and top grade lamb gut string. The samples were strung in three new racquets, each at a tension of 58 pounds, the tension normally used with gut string. In returning a tennis ball, tennis racquets including irradiated strings prepared in accordance with the invention exhibited much greater bounce or resilience than that experienced with untreated monofilament nylon string, and in fact showed slightly better resilience than the top grade gut string.

For the testing three new Wilson T2000 tennis racquets were strung, one with a good grade of monofilament sold under the trademark Dylco, one with top grade lamb gut multiple fiber string sold under the trademark VS, and one with my irradiated multifilament nylon string. Each racquet was rigidly suspended in a horizontal position by its frame, and fifty new, similar tennis balls were dropped on the center of each racquet from a height of 10 feet. The average return height for each of the strings was as follows:

Untreated nylon: — 73 inches
Lamb gut: — 83 inches
Irradiated nylon: — 85 inches Accomplished tennis players who tried racquets having my new string declared that the string played "excellent" or "good". One tennis champion stated that the new string was "not quite as resilient" as gut string, but the consensus was that the irradiated polymer string was much better than untreated synthetic string, approaching the resilience of gut string.

It has been found that following irradiation treatment of the synthetic polymer string, solar radiation, possibly ultraviolet radiation, has a slight further curing effect on the string so that the string tends to shrink in length to a very small degree in response to solar exposure. Thus, the string produced in accordance with the invention can be sun-cured prior to stringing in a racquet frame if desired. However, since the solar effect seems to increase tension by a maximum of only one percent, a racquet may be strung at the desired tension immediately following irradiation without noticeable difference in play characteristics.

The above described preferred embodiment provides an improved tennis racquet and tennis racquet string, as well as a method of producing the string, which approximates natural gut string at greatly reduced cost. Minor variations to these preferred embodiments will be apparent to those skilled in the art and may be made without departing from the spirit and scope of the following claims.

I claim:

1. A tennis racquet having stretched and tensioned synthetic strings with resilience similar to that of natural gut strings, said strings being produced by providing a filament of a polymer material and irradiating the filament with a radiation dosage of about 7.5 to 12.5 megarads, thereby causing crosslinking of molecules and increasing the stretch resilience of the filament.

2. A method for making a tennis racquet with synthetic strings, comprising:

twisting together a plurality of filaments of synthetic polymer material;

irradiating the filaments sufficiently to cause crosslinking of molecules, thereby changing the physical properties of the filaments, including increasing resilience when under tension; and installing the irradiated string in a tennis racquet frame, stretched to a tension of about 53 to 62 pounds.

3. A tennis racquet produced according to the method of claim 2.

4. The method of claim 2 wherein the radiation dosage is about 7.5 to 12.5 megarads.

* * * * *